United States Patent [19]

Ersoy

[11] Patent Number: 4,836,071

[45] Date of Patent: Jun. 6, 1989

[54] MODULAR PUNCH APPARATUS FOR PUNCHING COMPLEX SHAPES FROM A METAL RIBBON OR TAPE

[75] Inventor: Metin Ersoy, Walluf, Fed. Rep. of Germany

[73] Assignee: W. C. Heraeus GmbH, Hanau, Fed. Rep. of Germany

[21] Appl. No.: 150,088

[22] Filed: Jan. 29, 1988

[30] Foreign Application Priority Data

Feb. 6, 1987 [DE] Fed. Rep. of Germany ..... 3703649

[51] Int. Cl.[4] ..... B26D 7/18

[52] U.S. Cl. ..... 83/140; 83/637

[58] Field of Search ..... 83/140, 139, 138, 136, 83/637

[56] References Cited

U.S. PATENT DOCUMENTS 2,763,325 9/1956 Willous ..... 83/140

3,742,797 7/1973 Vecchi ..... 83/140

*Primary Examiner*—Donald R. Schran

*Attorney, Agent, or Firm*—Frishauf, Holtz, Goodman & Woodward

[57] ABSTRACT

To permit high-speed punching of complex shapes in extremely thin metal strips or ribbons, particularly for miniaturized semiconductor terminal elements, while using standardizing modular punch press components sush as a die, a stripper element and a punch carrier, with minimum longitudinal extent to suppress oscillations of the ribbon as it is being transported, at high punching frequencies, the stripper plate (2) is securely connected to a plurality of guide posts (6). Springs (18, 16) are provided which maintain the posts and the stripper plate in a base position, and lift the stripper plate above a die plate (1). These springs retain the posts, are circumferential spring rings (16) engaging a groove (17) in the posts and fitted in the die plate, or ball-and-detent arrangements (FIG. 9) coupling the die element (1) to the posts, while permitting yielding resilient relative movement between the die and the posts upon compression of the posts against the die during the punching stroke when the stripper element is engaged with the top surface of the workpiece strip (13). Workpiece guide pins (9) laterally guide the workpiece through the apparatus; the guide pins are spring-loaded to lift the workpiece off the die plate after a punching stroke to permit indexing or longitudinal movement of the workpiece.

22 Claims, 5 Drawing Sheets

MODULAR PUNCH APPARATUS FOR PUNCHING COMPLEX SHAPES FROM A METAL RIBBON OR TAPE

The present invention relates to an apparatus and machine to punch complex shapes from a metal ribbon or tape, in which the metal ribbon or tape is guided along matrices or punch counter elements on a punch counter plate and shifted, in cadence with the punching operation; and more especially to a machine which can make complex punched elements of small size, such as miniaturized connection terminals for electronic apparatus of smallest size.

BACKGROUND

Various types of sequential punching apparatus are known, in which metallic strip, ribbon, tape or the like is guided, in cadence with operation of the punching apparatus, along a predetermined path. Upon each reciprocating punching movement of the punch itself, the metal ribbon is advanced by one step. The punches themselves are located above the metal ribbon, movable towards and away from the surface of the metal ribbon. The punches are guided through a stripper plate which is located just above the metal ribbon which is to be punched, the stripper plate, or a similar element being pressed by spring pressure against the metal ribbon. The stripper plate may have guide openings to guide the punch, and retains the metal ribbon or workpiece blanks in position while permitting movement of the strip tape or ribbon as it is fed between punching strokes.

Machines of this type are well known, and used, primarily, to make various types of punched elements. They are used specifically to make contact plates, contact ribbons, contact elements and the like. With increasing miniaturization of electrical and electronic components, contact terminals which are punched also must be reduced in size. The punch configuration then becomes complex with extremely narrow contact paths remaining between punched openings. Such complex punched shapes frequently cannot be punched in a single punching stroke or step, but a plurality of punching steps are necessary.

To carry out multiple punching steps, sequentially operating punch apparatus are used which have a matrix with punch die openings corresponding to the respective individual punch shapes to be made. The raw or supplied contact ribbons or plates are guided along the die. The punches for the respective punch shapes are located above the contact ribbons, movable towards the contact ribbon. To prevent tipping or distortion of the contact band upon punching, that is, upon cutting thereof, and lifting of the remainder of the ribbon, after punching, as the punch reciprocates outwardly of the ribbon, a stripper plate is held during the entire punching operation against the upper surface of the contact ribbon through which the punches themselves are guided. The stripper plate is placed on the contact ribbon shortly before the punch touches the upper surface of the ribbon. It is removed from the contact surface only after the punch has completely withdrawn from the contact ribbon itself. When the stripper plate lifts, the remainder of the contact ribbon, after the punching operation is indexed by a step for the next punch. The stripper plate is also used to guide the punches which, for miniaturized components, necessarily will also be extremely thin and require guidance during the power stroke to effect accurate punching.

The individual punch shapes, necessary to make contacting elements, for example, are usually prepared in a single matrix die. This matrix die may have length which extend for example to about 80 cm—roughly under about 3 feet—and may even be longer. Sequential punch operations of this length are difficult to control. Varying the punch shape is not possible. Even minor changes in the punched shape require replacement of the entire die, although only a portion of the punched shape may be changed. The stripper plate, likewise, which moved during the punching operation, may require change. In order to provide sufficient stiffness and stability during the punching operation, the stripper plate must be made thicker and heavier as the machine dimension increases, which, in turn, increases the mass to be moved, or lifted during indexing movement of the workpiece ribbon, which, in turn, reduces the operating speed of the machine. Such stripper plates have the additional problem that it is usually necessary that a single highly skilled tool-and-die maker makes the entire plate, which detracts from versatility of scheduling of work in a shop.

It has been proposed to construct apparatus for sequential punching in modular form, see, for example, a report of a conference "Punching Techology - 76", published by the VDI publisher (Publication Office of the Society of German Engineers) entitled "Systematische Sicherung der Werkzeugqualitat" ("Systematic Assurance of Quality of Tools"). The individual work stations, which are necessary to obtain the desired punch configuration are combined in functional groups. For each group, a small and entirely independent tool is made, having its own upper and lower portion, working plate, guide posts and the like. The respective tool units, which form the punches, are then associated. Each such work station has modular plates which are associated with the respective punch shapes. The modular plates are made in the form of inserts which are located in a base structure adjacent each other, to be readily and quickly separable and interchangeable.

The structure has manufacturing advantages, but carries with it the disadvantage that a substantial larger number of the expensive and accurately machined guide posts are required, both base on the subdivision of the working station in functional groups, as well as the necessary increase in numbers due to the individual construction of the work station elements. The association of the respective work stations requires additional attachment connections, so that the coupling of associated modular plates requires additional length of the apparatus. The overall length of machines of this type, constructed in modular technology, is substantially increased with respect to a sequential punch operation having only a single stripper plate. The modular construction has the advantage that the individual modular plates can be changed, and remanufactured if the punch shape changes and, if the punch shape is such that malfunction or disturbances are expected, spare plates can be easily exchanged in connection with maintenance work, or when a malfunction actually occurs, without extensive and expensive down time of the machines. If specific modular are expected to have malfunctions, defects, or require frequent resharpening of punches, spare modules for replacement can be built. In case of malfunction or resharpening of a module in the punch unit, it is then possible to change the respective module quickly.

Additionally, the respective modular inserts of the plates are smaller, lighter in weight, and easier to handle. They can be made independently of each other, independently maintained and repaired. The individual stripper plates likewise are smaller and lighter. The springs necessary to lift and counteract weight of the plates can be made with lesser spring contents and weaker. Since the mass to be moved at each work station also is decreased, the punching frequency can be raised and apparatus of this type can operate with a stroke frequency of up to about 2,000 strokes per minute, corresponding, roughly, to a frequency of 33 Hz.

THE INVENTION

It is an object to provide a sequentially operating punching apparatus or machine, constructed in modular arrangement, which permits standardizing of the various modular parts, has smaller size than heretofore known, and in which oscillations of the workpiece or blank ribbon or tape are reduced or suppressed. Additionally, the dynamic forces necessary to move the various punch apparatus components, and particularly the stripper plate, should be reduced.

Briefly, the die plate, stripper plate, and punch carrier plate are formed in frame construction in which the respective plates corresponding to the individual punch shapes can be selectively located, sequentially positioned in the direction of the field of the blank ribbon or tape. The stripper plate is securely connected to at last two posts. Th posts can be moved from a base position in which the stripper plate is just barely spaced over the top surface of the blank ribbon into a compression position. Spring pressure is applied to the stripper plate to engage the top surface of the blank ribbon with the bottom side of the stripper plate. The various pressures and forces are so balanced with respect to each other that the sum of the forces which act on the ribbon guide elements, which are typically spring-loaded, corresponds at least approximately to the weight of the stripper plate; and the compression path upon compression of the spring corresponds to the space between the bottom surface of the blank ribbon and this stripper prior to punching.

The apparatus has the advantage that the punching stroke frequency can be increased even further, which is believed to be due to the constrained guidance of the stripper plate, which is lifted by the blank tape or ribbon guide elements themselves. The weight of the stripper plate is thus carried, not as before, by the drive system which also must move the punch element itself. Since the stripper plate engages the upper-side of the guide elements for the blank tape or ribbon, it is moved, after punching, for a distance which is only long enough to permit movement of the blank ribbon or tape to a next indexed position, without jamming or friction; only small clearance is necessary.

The lifting distance results in a gap which can be very small. This gap can be smaller than 0.5 mm, and preferably is less than 0.5 mm. Such a small gap effectively prevents the occurrance of oscillations at strokes over 800 per minute (about 13 Hz). Constructing the die plate, the stripper place, and the punch holder or carrier plate in frame form, in which the respective modular insert plates correspond to the desired punch shapes which are then are inserted, permits ready and easy change of the shape to be punched, and thus simple variation of the tool if the punch element is to be varied. The modular plates can readily be secured in the frame, the arrangement of the frame and the machine, and its connection with the drive in the machine tool remaining in place, so that exchange can be quickly carried out.

Fixed connection of the stripper plate with the posts which, together with the stripper plate form a support structure, has been found, surprisingly, to provide for increased stability with respect to structures in which the stripper plate is movable with respect to the posts ands guided, to slide therealong. In accordance with a feature of the invention, individual spring elements, or spring elements acting on an intermediate pressing plate, act on the respective posts, retaining the stripper elements in a base position in which the stripper plate is lifted off the blank tape or ribbon, so that the tape or ribbon can move freely, transversely to the machine for indexing movement in respective punch positions.

DRAWINGS

Figure 4:
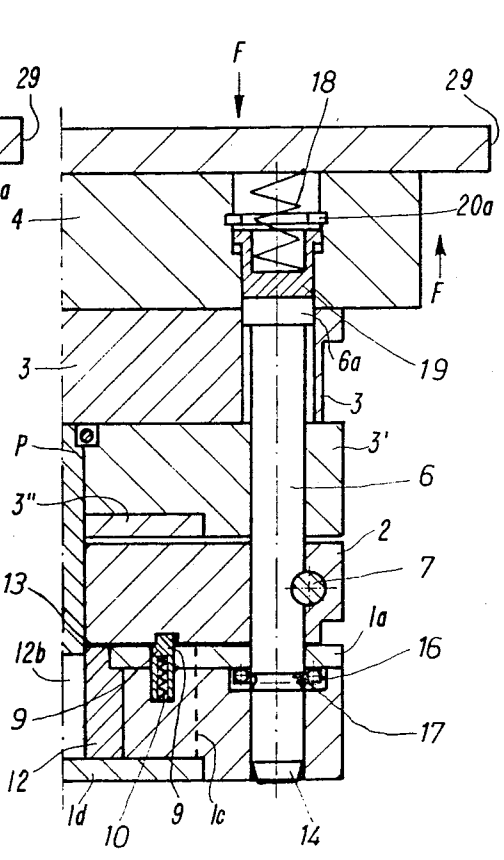
Figure 3:
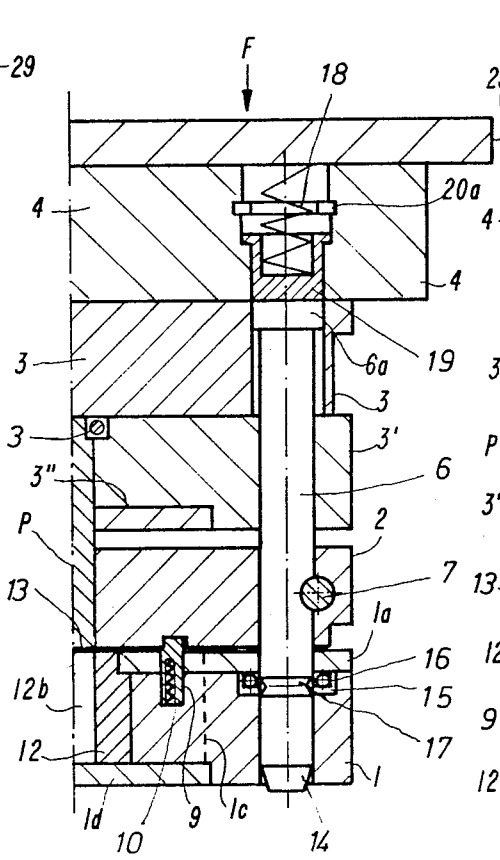
Figure 2:
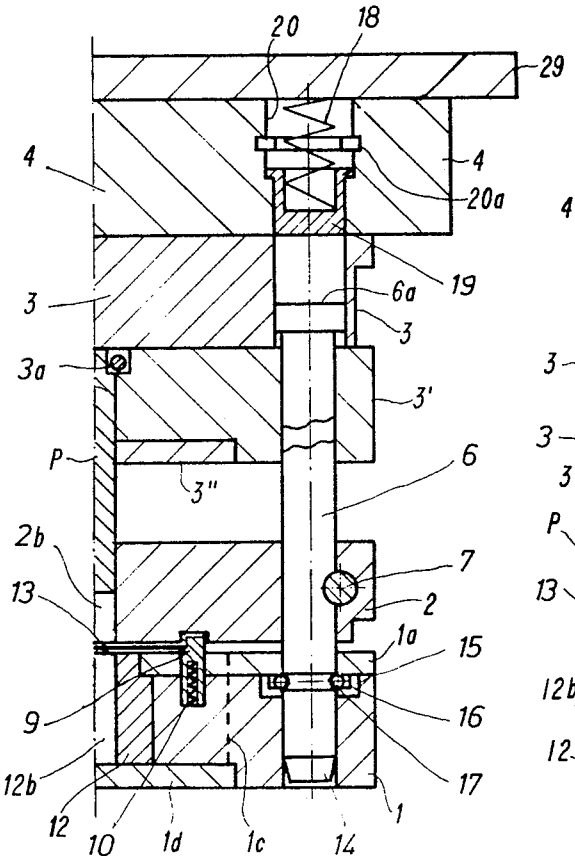
FIG. 2 is a detailed view of the punch in a first punching position, illustrating only a portion of the apparatus, necessary for an understanding of the present invention.
Figure 2A:
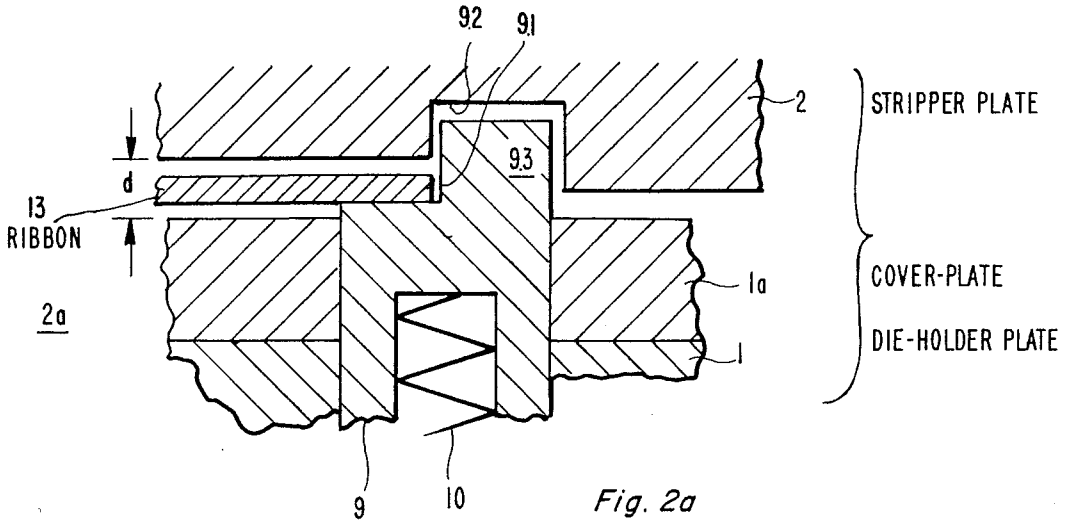
Figure 5:
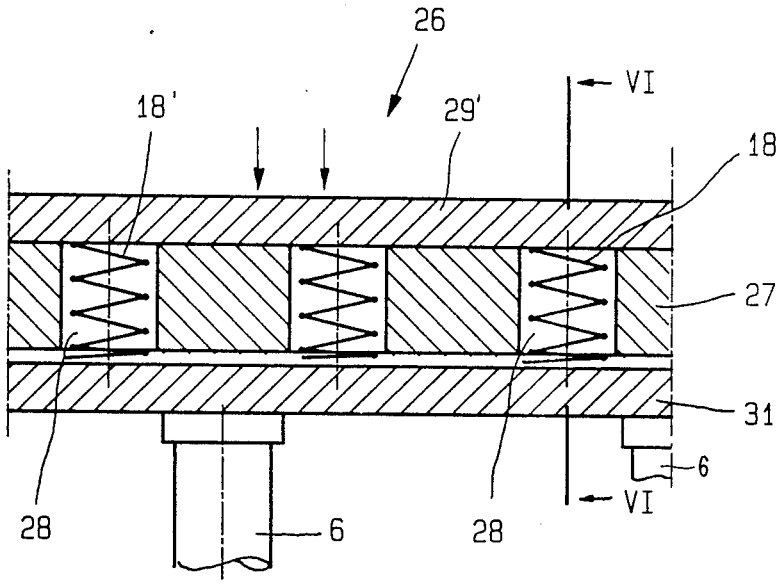
Figure 6:
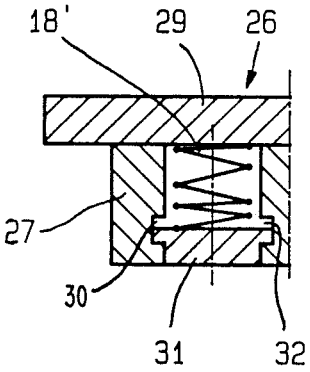
Figure 7:
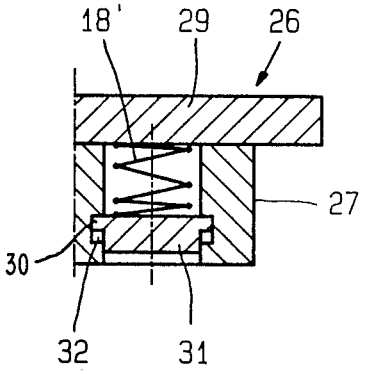
Figure 8:
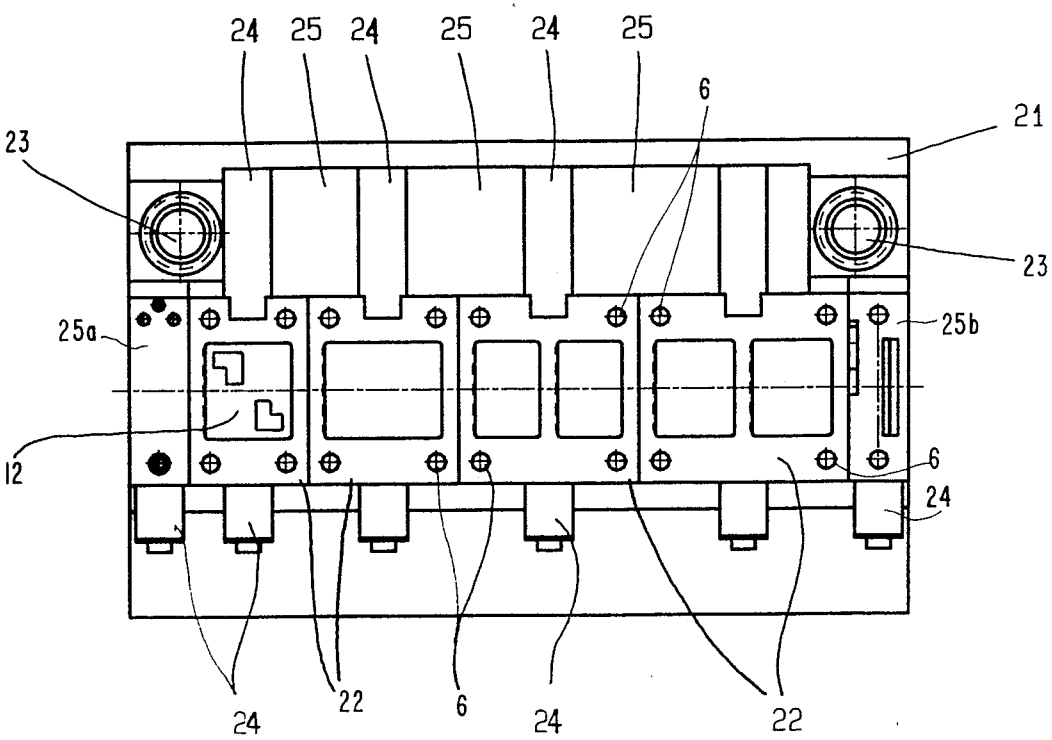

FIG. 2*a* is an exploded, enlarged fragmentary view of the blank tape or ribbon guide element and its association with the die plate and the stripper plate in which the elements are shown drawn apart;

FIG. 2*a* is an enlarged fragmentary view of the blank tape or ribbon guide element and its association with the die plate and the stripper plate;

FIGS. 3 and 4 are views similar to FIG. 2, to a similar scale, and illustrating the apparatus of FIG. 2 in sequential operating positions, with parts omitted for ease of illustration;

FIG. 5 is a fragmentary cross-sectional view through an upper portion of the tool, and illustrating a modification;

FIGS. 6 and 7 are fragmentary sectional views of modifications of the structure of FIG. 5, also suitable in the structures of FIGS. 1 to 4, and taken along line VI—VI of FIG. 5;

FIG. 8 is a top view of the tool, with the stripper plates removed; and

Figure 9:
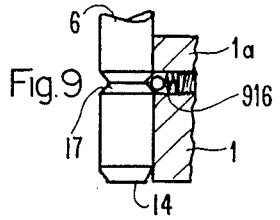

FIG. 9 is a fragmentary view of the structure of Figs. 1–4 illustrating a modification of retaining the post in position on the die plate while permitting relative movement with respect thereto.

DETAILED DESCRIPTION

Figure 1:
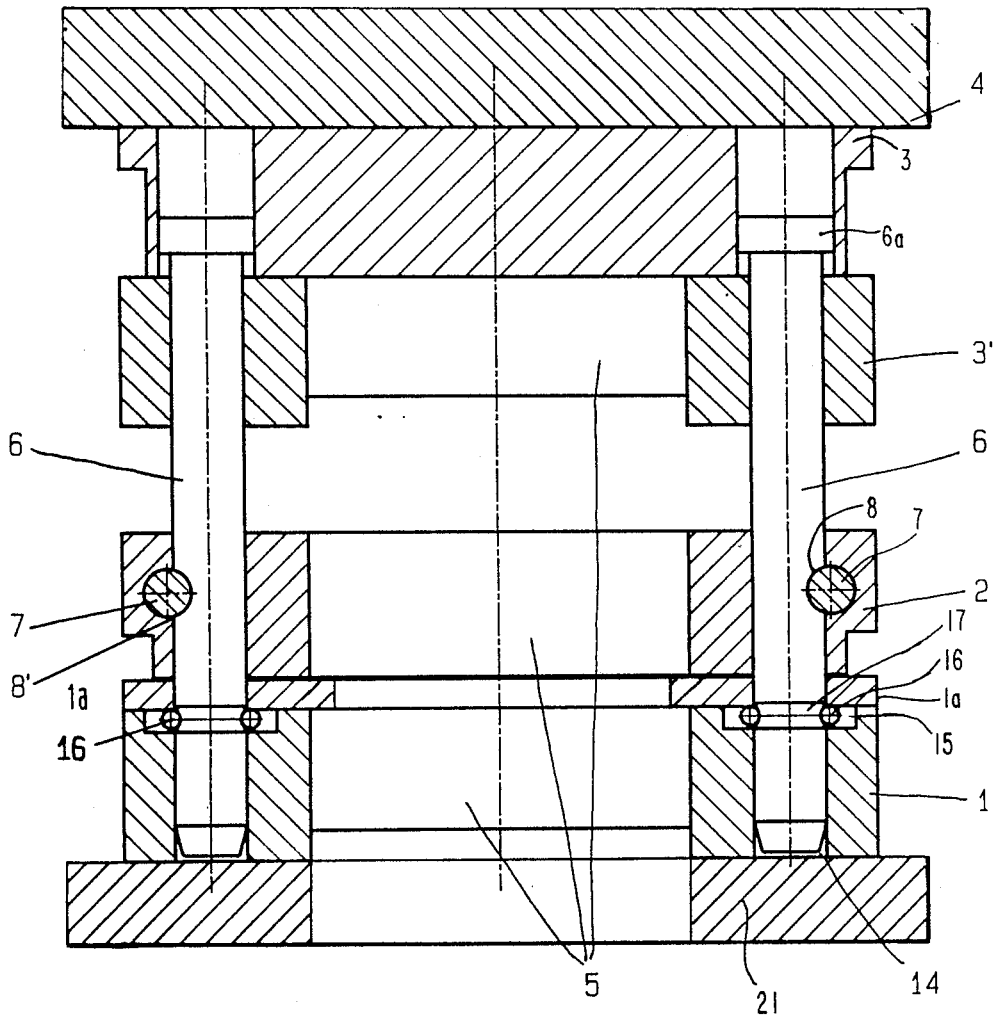
FIG. 1 is a general schematic cross-section through the tool in the region between two posts.

The basic machine is seen in FIG. 1 as a cross section comprising a head plate 4, a base plate 21 and at least between the head plate 4 and the base plate 21, two main posts 23 (FIG. 8) and a number of modules 22. The head plate 4 and the base plate 21 have a length at least the sum of the lengths of any module 22 (and, if required, in addition the length of the parts 25*a* and 25*b*). Each single module 22 with the different plates 1, 2, 3 and 3' and the module posts 6 together with inserts 5 and punches P are joined in the main body as shown in FIG. 8. The modules 22 are secured in position by clamps 24, 25.

Reverting now to FIG. 1: A plurality of vertically staggered or stacked plates of each module are guided by the posts 6.

The plates form modules or modular elements which carry inserts. These plates form, first, a die plate 1, a punch holder or punch carrier plate 3', a punching or punch support plate 3, a stripper plate 2, positioned over a workpiece in form of a blank strip, ribbon or plate 13, and a die holder plate 1.

According to a feature of the invention, the die holder plate 1, stripper plate 2 and punch holder plate 3' each are formed with a central opening defining a window or chamber 5 into which modular die elements, stripper elements and punch elements can be secured. These modular elements are not shown in FIG. 1. They may be of any standard construction. They are dimensioned to fit into the chamber or opening 5. These elements can be secured by screws, for example, in the respective plates, or by clamping plates or the like.

In accordance with another feature of the invention, the stripper plate 2, which retains stripper elements (not shown in FIG. 1) is secured at two sides to the posts 6, to be movable therewith. Thus, and contrary to prior art structures, the stripper plate is movable with the post 6, rather than being slidable with respect thereto. To permit quick removal and exchange of stripper plates, each of the posts 6 are formed with a part-circular lateral groove 8, into which a blot or pin 7 can be inserted, fitting into a matching part-circular groove 8' in the stripper plate 2. The cross bolts 7 can be secured in position in any suitable manner, not shown, and removal, as can be seen, will permit quick release of the connection between the stripper plates 2 and the posts 6. The posts 6 can be removed from the assembly as will appear below.

The posts 6 are slidable in the die plate 1. The punch holder plate 3' and the punching or punch support plate 3 likewise are slidable with respect to posts 6, or a post head 6a, respectively. FIG. 1 also shows a cover plate 1a placed over the die plate 1 to retain a die insert and a circumferential spring 16 in position.

The posts 6 and the die plates 1 are maintained in relatively movable, but restrained position. To this end, the die plate 1 is formed with a circumferential groove 15 surrounding the post 1. A circular spring 16, with circular cross section, is inserted in the ring grooves 15, and engages a circumferential groove 17 formed in the post 6. The circumferential groove 17 has wedge-shaped cross section, which maya be somewhat rounded. Preferably, the surface of groove 17 forms an angle of between 90° to 120° and, in an especially preferred arrangement, an angle in the upper range, that is, close to about 120°. Cover plate 1a covers the groove 15 and retains spring ring 16 in position round post 6. The cover plate **1*a* may also form a stop or clamping element for die inserts in the opening 5**.

The apparatus is shown in operative association with a workpiece or strip or ribbon 13 in FIGS. 2–4. The die plate 1 is formed with blind bores into which guide and lifter elements 9 are inserted, to guide and, in rest position, lift the workpiece strip or ribbon 13. Springs 10 urge the lifter elements 9 upwardly. The arrangment is best seen in FIG. **2*a*, which is an enlarged fragmentary exploded view of the region of the die cover plate 1*a* and die holder plate 1 in which the lifters are inserted. An end portion 9.3 extends above the top surface of the die cover plate 1*a*. It is formed with a cut-out, leaving a shoulder 9.1. The extending portion 9.3 fits into a recess 9.2 of the stripper plate 2. As can be seen guide element 9 guides the lateral edge of the workpiece strip or ribbon 13 at the corner of the shoulder 9.1, leaving the top of the workpiece strip 13 unobstructed. The projecting distance of the projecting portion 9.3 and the recess 9.2 in the stripper plate 2 are so dimensioned that, when the stripper plate 2 is to be raised, projection 9.3 fits against the end wall of the recess 9.2, to lift the recess 9.2 by the force of the spring 10**. A plurality of such guide and lifter elements are provided.

A removable bottom plate or strip 1d (FIG. 2) retains a replaceable die insert 12 in position. Standard attachment means, such as screws, dovetails and the like, have been omitted from the drawing for clarity. Only a single retention screw **1*c* is shown, schematically, in FIG. 2**.

In an alternate construction—see FIG. 9—the die plate 1 is formed with a radial bore into which a ball-and-detent arrangement 916 is inserted. Such a ball-and-detent arrangement is well known and includes, as is customary, a ball which engages the circumferential groove 17 of the post 6, a spring biassing the ball towards the groove 17, and an outer, usually threaded plug which closes off the opening and permits, upon threading inwardly, change of the spring tension with which the ball engages the groove 17.

The apparatus permits punching of very thin strips or ribbons 13, for example of only about 0.25 mm thickness. The workpiece strip or ribbon 13, therefore, is shown only by line 13. The strip 13 can slide in a gap between the die plate 1 and a die insert 12, respectively, and the stripper plat 2, or a stripper insert therein, for longitudinal transport of the apparatus by a suitable transport or indexing arrangement. This gap dimension d in FIG. **2*a*, normally, is a little larger than the thickness of the workpiece and only up to twice the thickness of the workpiece strip. When spring 10 raises element 9, a gap of about 0.125 mm, each, will result between the strip 13 of 0.25 mm thickness and the top surface of the die insert 12 in the die plate 1 and the facing surface of the stripper plate 2**, respectively. For a strip of about ½ mm thickness, a dimension d of about 1 mm is suitable.

FIG. 2 illustrates the apparatus in expanded position, with the elements not located to scale. Stripper plate 2 is lifted off workpiece strip, or ribbon, or tape, or plate 13. In this position of FIG. 2, the spring ring 16 engages the bottom region of the groove 17 in the post 6. The ribbon guide and lifter elements 9, which customarily are in the shape of round bolts with the shoulder 9.1 thereon, engage with their upper surface against the bottom surface of the ribbon 13, and with the bolt end 9.3 in the bottom of recess 9.2 of the stripper 2. The punch holder plate 3' is engaged by the punch support plate 3. A punch element P, shown only schematically in FIG. 2, is retained in a holder plate 3' with an insert 3'', which is secured to the punch support plate 3. The punch P and the punch holer plate 3' are formed with adjacent recesses in which a holding pin **3*a* for the punch P can be inserted. Plate 3 is formed with an opening sufficiently large to accept the head 6*a* of the post 6. The plate 3', thus, is precisely guided by the post 6. As can be seen, the punch P extends into a suitable opening 2*b* formed in the stripping plate 2**, to be guided therein.

The die insert 12 is formed with openings **12*b* aligned with openings 2*b*. The die insert 12 is held in position between an overlap of cover plate 1*a* and bottom strip 1*d*, clamped by screw 1*c***.

The die insert 12 is shown schematically only. It may be a composite element, having a comparatively thin, precisely machined die matrix, spacer plates and die blocks. Since such constructions are conventional, they are not separately identified in the drawings.

OPERATION—WITH REFERENCE TO FIGS. 3 AND 4

In order to initiate a punching operation after strip 13 has been placed and a punch inserted (see FIG. 2), the head plate 4 is moved under force F (FIG. 3), shown only schematically by a force arrow in downward direction. This causes compression of springs 18 located in the head plate 4. Spring elements 18 are pressed downwardly by a force transfer plate 29 against which the force is actually applied. The spring element 18 presses against an insert 19, retained in a recess 20 in the plate 4, which engages the head 6*a* of the post 6. The post 6 is punched downwardly by the pressure of the spring 18 and carries along stripper plate 2 which is securely coupled to the post 6 by the pin 7. Stripper plate 2 and a stripper insert therein thus are resiliently pressed downwardly against the workpiece or ribbon 13, so that the workpiece strip or ribbon 13 is engaged against the die inset 12 and, at the edges on the shoulder 9.1 of the lifter 9. The lifter 9, likewise, will be depressed into the opening formed in the die holder plate 1 and the cover plate 1*a* by engagement of the bottom wall of the recess 9.2 against the projecting portion 9.3. The clearance distance, prior to compression, shown in FIG. 2 at d, can be very small. It may be about 5 mm, most desirably in the order of about 1 mm, but may be less, and even less than 0.5 mm for extremely thin foil-like workpieces.

Reference is now made to FIG. 4 which illustrates the punch in actual punching position. Upon continued application of force F, punch P will penetrate clear through the workpieces trip or ribbon 13. In this position, the groove 17 in the post 6 is out of fixed engagement with the spring ring 16—or the ball of the ball-and-detent arrangement 916 (FIG. 9)—so that the post 6 is shifted to a lower position. The spring arrangement 16, or the equivalent spring in the ball-and-detent arrangement 916, is under tension. This is the lower dead center (LDC) position.

The distances and spacings shown in the drawings, FIGS. 2–4, have been distorted for clarity. Post 6 is shown broken in FIG. 2 for ease of visualization of overall structure.

After the punching operation, and subsequent to the LDC position (FIG. 4), a lifting force schematically indicated by arrow F′ is applied against plate 29. This lifts the punch support plate 3 and associated punch holder plate 3′. The stripper plate 2, initially remains in the engaged lower position until the punch P is completely withdrawn and removed from the workpiece strip or ribbon 13 (see FIG. 3). Upon subsequent continued raising of the plate 4 in an upward direction, the posts 6 are released and can move upwardly due to the force being applied by the spring 16, or the equivalent spring of the arrangement 916 of FIG. 9, against the inclined surfaces of the groove 17. This shifts the posts 6 into the stable position shown in FIG. 2. The stripper plate 2 is also raised off the workpiece strip or ribbon 13 to reestablish the clearance space. The guide elements 9, spring-loaded by the springs 10, effect this raising operation of the stripper plate 2, and also raise the now punched strip 13 off the die insert 12 and the holder late 1a.

A removable snap ring 20a, fitted into a groove in recess 20, limits toward movement of insert 19 and relieves pressure of spring 18 on the post 6 as plate 29 is raised, thus assisting in permitting spring 16—or the equivalent spring of the ball-and-detent arrangement 916—to return post 6 to the rest position shown in FIG. 2.

The shoulder 9.1 formed in the guide element 9 is made wider than the thickness of the workpieces guided therein; it engages the lower surface of the metal workpieces strip or ribbon 13, so that the workpiece strip or ribbon 13 is also lifted off the die plate to permit easy indexing, shifting and transport thereof in a plane perpendicular to the plane of the drawing. This arrangement to guide the workpieces is particularly suitable for suppressing oscillation in the workpiece, especially when it is in ribbon form, and when the stroke frequency, and hence the punching frequency, is at a high rate.

The plates which carry the punches P, stripper inserts (not separately shown), and the die insert 12 can all be easily interchanged due to modular construction. If the metal strip or ribbon has to be inspected, for example because of occurrence of slugs, the gap "d" can be enlarged without moving the entire tool out of the press and without losing any screws, namely by just moving up the press ram more than the adjusted press stroke. In that case the posts will be lifted or pushed out from below with the ring spring 16 merely escaping into the ring groove 15 formed in the die plate 1, which is made sufficiently large. The posts 6 in the ball and the spring in the arrangement of FIG. 9 can be moved away.

The overall structure of the modular tool is best seen in the top view of FIG. 8. The lower or base plate 21 is arranged to hold a plurality of modular plates generally shown at 22. The modular plates 22 are formed with the openings defining the chambers 5 (FIG. 1) in which respective standardized inserts can be plated, for example the inserts 12. These inserts carry the respective punch patterns. In dependence on the position in the apparatus, other inserts may be placed in the modular plates, for example into punch holder plate 3′, such as insert punches shown schematically at P, or strip plate inserts which also carry the punch pattern may be placed into stripper plate 2. These inserts can be retained in the stripper plate 2 in any suitable manner, for example by two clamping insert plates similar to the plates 1*a*, 1*d* shown on the die plate 1, by screw connections, clamping screws, conical pins or the like.

Reverting again to FIG. 8: The die plates 1 of the modules 22 are clamped to the base plate 21 at the lateral rims thereof by clamping elements 24. The clamping elements 24 are spaced from each other by spacer blocks 25. The clamping elements 24 can be located on the base plate 21 in well known machine tool construction manner, for example by insertion into T-slots and the like, or engagement with ribs and/or projections formed on the base plate 21. This arrangement of securing the modules 22 permits simple variation in the sequence of the punching operations, by suitable placement of inserts into the modules, or replacement of the modules in different sequences. The modules, likewise, can be easily and quickly removed and exchanged. The main posts 23 are suitably located on the base plate, for example as shown in FIG. 8.

Various modifications and changes may be made. For example, frequently it is desirable to associate an individual spring element 18 with each post 6, as seen in FIGS. 2–4. The respective spring elements 18 directly engage the ends or heads 6a of the respective posts 6. If highly complex punch shapes have to be made, however, in which the length of the overall machine tool is so increased that guidance of the respective plates on two or four lateral or corner posts is not sufficient, it may be necessary to replace the engire upper structure. To provide for versatility, and also to make the upper portion of the tool more adaptable to modular construction, a separate upper element 26 (FIGS. 5–7) may be desirable. The upper element 27 can have the individual spring elements 18 and the inserts 19. It permits association, for example, with two or more individual posts, to span two or three or more posts or modules for example. A similar element can be used for a subsequent row or group of posts.

Referring to FIGS. 5–7: The upper structure 26 forms a frame of framing elements 27 which include throughbores 28 in which individual springs 18' are inserted. The springs 18' correspond, in function, to the springs 18 of the embodiment of FIGS. 2–4. The structure 26 is closed off by the upper plate 29'. The lower plate 31, in a strip form, is inserted in a groove 30 (FIG. 6) formed in the framing elements 27. Strip 31 is slidable in the region of a guide groove 32. Strip 31 can move up and down, as seen by comparing FIGS. 6 and 7. The springs 18 can readily be interchanged after removal of the upper structure 26 from the entire punching tool apparatus. Strip 31 can be merely slid out laterally and the springs 18' replaced by other springs, for example of different spring constant. The posts 6, likewise, can be replaced independently of the position of the springs 18'.

The upper structure 26 can be used with the base plate 21 (FIG. 8) and the punching arrangement shown in FIGS. 1–4. It can be used, however, also independently with other punching apparatus, in which a stripper plate and tape and ribbon guide elements are constructed differently from those shown in the drawings of FIGS. 1–4.

The stripper plate 2 can easily be exchanged by the arrangement in which the pins 7 engage in the grooves 8 and 8' of the posts and the stripper plate, respectively. To interchange the stripper plate, it is then only necessary to remove the pins 7. The pins 7 may be cylindrical or slightly conical to permit, for example, tightening of the pins 7 in the respective grooves 8,8'. The posts 6 themselves are slidable in guide bores in the die plate. The holding arrangement formed by the spring 16 or the ball-and-detent arrangement 916 (FIG. 9) provides for positive positioning of the posts in the die plate, while permitting resilient departure from the positive position for a limited distance. In view of the small dimension of the distance d, the conical groove 17 in the post is entirely sufficient. In the base position, the stripper plate 2 is lifted off the top side of the workpiece ribbon strip or tape 13.

Other arrangements than a circumferential groove 17, and the circumferential spring 16 or the ball-detent arrangement 916 may be used. The wedge, or angular shape groove 17, however, is a preferred shape, since this arrangement permits movement of the posts 6 relative to the die plate 1 while still providing a fixed or lock or base position. Groove angles between about 90° to 120°, and preferably towards the higher range, ensure a stable base position while still permitting shift of the posts 6 from the base position counter the spring pressure of the spring 16 or the ball-detent arrangement 916. The spring 16 or the ball-detent arrangement 916, or several of such ball-detent arrangements located, for example, circumferentially about the posts 6, are preferred; other arrangements to hold the posts in a fixed or base position while permitting resilience departure therefrom for a limited distance may be used.

The apparatus is versatile not only with respect to framing elements, inserts and modules, but also with respect to the spring elements which act on the pressure plates. Thus, the arrangement described in connection with FIGS. 5 to 7 has the advantage that a strip 31 can be used which is engaged by a plurality of spring elements, so that the individual springs 18' need not be associated with a predetermined post 6 at a predetermined position. Thus, and without substantial reconstruction or reassembly, the number and position of the posts can readily be changed. Preferably, the strips 31 together with the springs 18' form part of an upper assembly in which the strip elements are retained by the springs in a lower position within a groove 32 having vertical clearance. The structure 26, together with the strip element 31, may form an exchangeable unit. Such an arrangement is particularly advantageous when combined with the stripper plate and the overall structure as described since, then, the lower region of the punch apparatus, as well as the upper region of the punch apparatus, both are versatile and variable to permit easy matching to required operating conditions. The upper element 26 (FIGS. 5 to 7) may also be used in punch apparatus which have different stripper plate arrangements.

The spring force of the springs 10 coupled to the guide elements 9 are so arranged that the sum of the spring fores acting on the springs 10 correspond at least to the counter weight or force due to the weight of the stripper plate 2 itself and the compression force of the spring ot b overcome upon compression of the spring for the distance of the space between the stripper plate 2 and the surface 11 of the die plate 1.

FIG. 8 also shows end plates **25*a*, 25*b*, for example to cover unused portions of the base plate 21, or to receive holding elements or structures, for example also secured in position by clamps 24, 25** and/or screws or other holding elements as well known.

Various changes and modifications may be made and features described in connection with any one of the embodiments may be used with any of the others within the scope of the inventive concept.

I claim:

1. Punch press apparatus for sequentially punching shapes, particularly complex shapes, from a workpiece comprising a metal strip or ribbon (13), having a die plate (1);

a punch element (P);

a stripper plate (2) located above the die plate;

a punch holer plate means (3, 3') carrying the punch element (P), located above the stripper plate; .

a plurality of posts (6) retaining and stacking said plates and guiding relative movement of the die plate (1), the stripper plate (2) and the punch holder plate means (3, 3') when carrying out a punching stroke;

workpiece guide elements (9) located on the die plate (1) for guiding the workpiece in a predetermined path over the die plate between the die plate and the stripper plate; and wherein said stripper plate (2), when in a rest position between punching strokes and when out of engagement with the workpiece (13), is spaced from the top surface of the die plate by a distance which is only up to twice the thickness of the workpiece;

at least the die plate (1) and the punch holder plate means are, in plan view, frame shaped and define an open window or chamber (5) centrally of said plates for reception of modular inserts corresponding to the shapes to be punched;

the stripper plate (2) is connected to at least two of said posts (6);

resiliently yielding holding spring means (16, 916) are provided, positioned for coupling the die plate (1) to said at least two posts in predetermined position relative to the stripper plate (2) and spaced from the stripper plate sufficient to provide just enough clearance for the workpiece to move across the die plate between punching strokes;

and force means (F, 4, 3, 29, 26) are provided acting on said punch holder plate means (3, 3') and on at least said two posts (6) and of sufficient strength for overriding said yielding holding means (16, 916) for moving said stripper plate into engagement with the workpiece to clamp the workpiece (13) during a punching stroke and further for moving the punch holder plate means and thus the punch element (P) against the workpiece (13);

wherein the guide elements (9) are located at least in part below the workpiece (13), and said guide element define the lateral dimensions of said guide path only while leaving free the surface of the strip or ribbon first engaged by the punch element during a punching operation;

guide spring means (10) are provided, coupled to the guide means (9) and positioned for biassing the guide means upwardly against the workpiece, and wherein the sum of the spring forces of the guide spring means (10) acting on said guide elements corresponds at least approximately to the weight of the stripper plate; and the guide spring means (10) compression path corresponds at least approximately to the distance (d) between the top surface of the die plate and a facing surface of the stripper plate (2) when the stripper plate is out of engagement with the workpiece (13) and between punching strokes, and the stripper plate, upon withdrawal of the punch element (P), is raised above the die plate (1) by a distance which is only up to twice the thickness of the workpiece.

2. The apparatus of claim 1, wherein said at last two posts (6) are formed with a groove (8) extending along a chord on the circumference thereof in the region of the stripper plate (2);

said stripper plate (2) formed with a recess (8') in alignment with said grooves;

and a coupling pin (7) is inserted in said groove and in said recess for securely connecting together the stripper plate (2) and said at least two posts (6) while permitting disassembly upon removal of said pin.

3. The apparatus of claim 1, wherein the die plate (1) is formed with guide bores (14) receiving said at least two posts (6) for sliding movement therein;

and wherein said resiliently yielding holding spring means comprises a circumferential groove (17) formed in the at least two posts;

a groove (15) formed in the die plate and in alignment with said circumferential groove (17);

and a spring ring (16) fitted in the circumferential groove (17) of each of said at least two posts and retained in position on the die plate in the groove (15) formed in the die plate.

4. The apparatus of claim 3, wherein the groove (17) in each of said at least two posts extends throughout the entire circumference of the post.

5. The apparatus of claim 3, wherein the groove (17) formed in each of said at least two posts has an approximately wedge-shape or triangular cross-section.

6. The apparatus of claim 5, wherein the approximately wedge-shaped or triangular cross-section defines an angle of between about 90° to about 120°.

7. The apparatus of claim 6, wherein the groove is dimensioned to receive part of the cross-section of said spring ring.

8. The apparatus of claim 3, wherein the groove (15) in the die plate is of sufficient size to entirely accept said spring ring (16).

9. The apparatus of claim 1, wherein (FIG. 9) the die plate is formed with guide bores (14) receiving said at least two bolts for sliding movement therein; and said resiliently yielding holding spring means (916) comprises a spring-loaded ball-and-detent arrangement (916) including a recess (17) formed in each of said at least two posts, and a spring-loaded ball located within a bore of said die plate (1) and engaging said recess, but permitting resilient escape of said ball into the bore of the die upon relative displacement of said at least two posts with respect to the die plate.

10. The apparatus of claim 9, wherein the recess (17) in said at least two posts is essentially wedge-shaped or triangular and includes an angle of between about 90° to 120°.

11. The apparatus of claim 1, wherein the facing surface of the stripper plate (2), when the stripper plates is in rest position, has a spacing from the top surface of the workpiece (13), when the workpiece is placed above the die plate (1), of less than about 0.5 mm.

12. The apparatus of claim 1, wherein the facing surface of the stripper plate (2), when the stripper plate is in rest position, has a spacing (d) from the top surface of the die plate (1) of between about 0.2 to 5 mm.

13. The apparatus of claim 1, further comprising spring means (18, 18') interposed between said force means (F, 4, 3, 29, 26) and said posts (6) for resiliently transferring the force of said force means to said posts.

14. The apparatus of claim 13, wherein the spring means comprises individual springs (18) respectively associated with individual posts (6).

15. The apparatus of claim 1, wherein the plurality of posts (6) are located in at least one row in relative mutual alignment;

and the force means comprises a compression or force transfer plate (29) subject to a compression force to effect punching operation;

a force distribution plate (31) located on top of said posts (6);

the spring means (18') comprises compression springs (18') spacing said compression force transfer plate (29) from the force distribution plate (31) located between said plates;

and force transfer elements (27) positioned between said compression or force transfer plate (29) and the force distribution plate (31) and moving said force distribution plate (31) after initial compression of said compression spring (18') for transfer of force from said force means to said posts.

16. The apparatus of claim 15, wherein said compression or force transfer plate (29) and said force distribution plate (31) including said compression springs (18') and force transfer element (27) comprises a unitary assembly (26).

17. The apparatus of claim 15, wherein said force distribution plate (31) comprises a plurality of plate-like insert strips (31), and said force transfer elements include spacing blocks (27) formed with a groove (32) and bores (30), said bores extending vertically between said strip elements and said compression or transfer plate and receiving said compression springs, said groove extending transversely to said bores, and receiving said force distribution plate strip elements for sliding movement relative to said bores and engagement by a plurality of said compression spring elements to permit selective placement and repositioning of at least some of said plurality of posts in said aligned row while maintaining uniform application of said compressive force.

18. In combination with a punch press apparatus, particular for punching complex shapes from a workpiece (13) comprising a metal strip or ribbon having a die plate (1);

a stripper plate (2) located above the die plate;

a punch holder plate means (3, 3') carrying a punch element (P);

a plurality of posts (6) guiding relative movement of the die plate (1), the stripper plate (2) and the punch plate means (3, 3') when carrying out a punching stroke;

force means (F) acting on the punch plate means for moving at least said punch plate and said stripper plate during punching stroke; and wherein the plurality of posts (6) are located in at least one row in relative mutual alignment;

and means are provided for resiliently transferring force from said force means also to said posts, comprising a compression or force transfer plate (29) subject to a compression force to effect punching operation;

a force distribution plate (31) located on top of said posts (6);

compression spring means (18') spacing said compression force transfer plate (29) from the force distribution plate (31);

and force transfer elements (27) positioned between said compression or force transfer plate (29) and the force distribution plate (31) and moving said force distribution plate (31) after initial compression of said compression spring (18') for transfer of force from said force means to said posts.

19. The combination of claim 18, wherein said compression or force transfer plate (29) and said force distribution plate (31) including said compression springs (18') and force transfer element (27) comprise a unitary assembly (26).

20. The combination of claim 18, wherein said force distribution plate (31) comprises a plurality of plate-like insert strips (31), and said force transfer elements include spacing blocks (27) formed with a groove (32) and bores (30), said bores extending vertically between said strip elements and said compression or transfer plate and receiving said compression springs, said groove extending transversely to said bores, and receiving said force distribution plate strip elements for sliding movement relative to said bores and engagement by a plurality of said compression spring elements to permit selective placement and repositioning of at least some of the plurality of posts in said aligned row while maintaining uniform application of said compressive force.

21. The combination of claim 1, wherein the stripper plate (2) is securely connected to at least two of said posts (6).

22. The combination of claim 1, wherein said punch holder plate means comprises a punch support plate (3) supporting the punch element and a punch holder plate (3').

* * * * *